US010920331B2

(12) United States Patent
Sato et al.

(10) Patent No.: US 10,920,331 B2
(45) **Date of Patent: *Feb. 16, 2021**

(54) FILM DEPOSITION DEVICE OF METAL FILM AND METAL FILM DEPOSITION METHOD

(71) Applicant: TOYOTA JIDOSHA KABUSHIKI KAISHA, Toyota (JP)

(72) Inventors: Yuki Sato, Toyota (JP); Hiroshi Yanagimoto, Miyoshi (JP); Motoki Hiraoka, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 55 days.

This patent is subject to a terminal disclaimer.

(21) Appl. No.: 14/910,416

(22) PCT Filed: Aug. 4, 2014

(86) PCT No.: PCT/IB2014/001459

§ 371 (c)(1),
(2) Date: Feb. 5, 2016

(87) PCT Pub. No.: WO2015/019154

PCT Pub. Date: Feb. 12, 2015

(65) Prior Publication Data

US 2016/0194777 A1 Jul. 7, 2016

(30) Foreign Application Priority Data

Aug. 7, 2013 (JP) ..... 2013-163816

(51) Int. Cl.
*C25D 5/22* (2006.01)
*C25D 17/12* (2006.01)
(Continued)

(52) U.S. Cl.
CPC ..... *C25D 5/22* (2013.01); *C25D 5/02* (2013.01); *C25D 5/04* (2013.01); *C25D 5/08* (2013.01);
(Continued)

(58) Field of Classification Search
CPC ..... C25D 17/002
(Continued)

(56) References Cited

U.S. PATENT DOCUMENTS 4,326,930 A 4/1982 Nagel et al.
5,453,174 A 9/1995 Anglen et al.
(Continued)

FOREIGN PATENT DOCUMENTS

CN 104011269 A 8/2014
JP 55-138892 A 10/1980
(Continued)

OTHER PUBLICATIONS

"Thermodynamics and Proton Transport in NAFION" by Choi et al., J. Electrochem. Soc. 152(3), pp. E84-E89 (2005).*
(Continued)

*Primary Examiner* — Harry D Wilkins, III
(74) *Attorney, Agent, or Firm* — Sughrue Mion, PLLC

(57) ABSTRACT

A film deposition device (1A) of a metal film (F) includes a positive electrode (11), a solid electrolyte membrane (13), and a power supply part (14) that applies a voltage between the positive electrode (11) and a base material (B) to be a negative electrode. The solid electrolyte membrane (13) allows a water content to be 15% by mass or more and is capable of containing a metal ion. The power supply part (14) applies a voltage between the positive electrode and the base material in a state where the solid electrolyte membrane is disposed on a surface of the positive electrode such that metal made of metal ions contained inside the solid elec-
(Continued)

trolyte membrane (13) is precipitated on a surface of the base material (B).

4 Claims, 3 Drawing Sheets

(51) Int. Cl.
*C25D 17/00* (2006.01)
*C25D 5/02* (2006.01)
*C25D 5/04* (2006.01)
*C25D 17/10* (2006.01)
*C25D 5/08* (2006.01)
*C25D 3/38* (2006.01)

(52) U.S. Cl.
CPC ..... *C25D 17/00* (2013.01); *C25D 17/002* (2013.01); *C25D 17/10* (2013.01); *C25D 17/12* (2013.01); *C25D 3/38* (2013.01)

(58) Field of Classification Search
USPC ..... 205/93
See application file for complete search history.

(56) References Cited

U.S. PATENT DOCUMENTS 6,042,712 A * 3/2000 Mathieu ..... B23K 20/004 205/209
6,277,261 B1 * 8/2001 Divisek ..... C25B 9/10 205/114
6,375,823 B1 4/2002 Matsuda et al.
6,913,681 B2 * 7/2005 Matsuda ..... C25D 17/12 205/117
7,943,019 B2 5/2011 Otogawa et al.
7,998,323 B1 * 8/2011 Chandra ..... C25D 5/22 204/224 M
9,840,786 B2 * 12/2017 Sato ..... C25D 5/08
9,909,226 B2 * 3/2018 Hiraoka ..... C25D 17/002
10,047,452 B2 * 8/2018 Hiraoka ..... C25D 5/08
10,151,042 B2 * 12/2018 Usui ..... C25D 5/02
2002/0020627 A1 * 2/2002 Kunisawa ..... H01L 21/6715 205/96
2002/0134674 A1 9/2002 Andrews et al.
2002/0148732 A1 * 10/2002 Emesh ..... H01L 21/6723 205/117
2005/0023149 A1 * 2/2005 Nakada ..... C25D 17/06 205/137
2005/0051437 A1 3/2005 Kurashina et al.
2006/0175202 A1 * 8/2006 Mazur ..... H01L 21/2885 205/149
2006/0199270 A1 9/2006 Parnas et al.
2007/0051619 A1 * 3/2007 Mazur ..... H01L 21/7684 204/250
2008/0217182 A1 * 9/2008 Dai ..... C25D 5/02 205/93
2009/0050487 A1 2/2009 Fang et al.
2009/0242410 A1 10/2009 Castro et al.
2010/0040927 A1 2/2010 Yoshida et al.
2010/0230278 A1 9/2010 Taruya et al.
2011/0147202 A1 6/2011 Haryu et al.
2011/0180398 A1 7/2011 Nakazawa et al.
2011/0180416 A1 7/2011 Kurashina et al.
2013/0112563 A1 * 5/2013 Tomantschger ..... C25D 5/08 205/101
2014/0224662 A1 8/2014 Arumugam et al.
2015/0014178 A1 * 1/2015 Hiraoka ..... C25D 5/08 205/261
2016/0108534 A1 4/2016 Dai et al.
2016/0177463 A1 6/2016 Arumugam et al.
2016/0177464 A1 6/2016 Sato et al.

FOREIGN PATENT DOCUMENTS

JP 01165786 A 6/1989
JP 05-070986 A 3/1993
JP 05148681 A 6/1993
JP 10-121282 A 5/1998
JP 2002-004091 A 1/2002
JP 2004-353014 A 12/2004
JP 2005-42158 A 2/2005
JP 2005133187 A 5/2005
JP 2008-097868 A 4/2008
JP 2010-037622 A 2/2010
JP 2011-011493 A 1/2011
JP 2012-219362 A 11/2012
JP WO 2013/125643 A1 * 8/2013 ..... C25D 17/12
JP 5605517 B2 10/2014
WO 2006/067337 A2 6/2006
WO 2007/106911 A2 9/2007
WO 2013/125643 A1 8/2013

OTHER PUBLICATIONS

Hinatsu et al, Water Uptake of Perfluorosulfonic Acid Membranes from Liquid Water and Water Vapor, Journal of the Electrochemical Society, vol. 141, No. 6, Jun. 1994, pp. 1493-1498 (Year: 1994).*
Cappadonia et al, Conductance of Nafion 117 Membranes As a Function of Temperature and Water Content, Solid State Ionics, vol. 77, Apr. 1995, pp. 65-69 (Year: 1995).*
"Solid Phase Plate Contact Electrolytic Object Apply Voltage Anode Connect Cathode", Database WPI Week, 198932 Thomson Scientific, London, GB, AN 1989-231016, XP-002735308, PD Jun. 29, 1989 2 pages.
Communication dated May 3, 2017, from the United States Patent and Trademark Office, in counterpart U.S. Appl. No. 14/910,365.
International Search Report for PCT IB/2014/001459 dated Feb. 9, 2015.
Notice of Allowance dated Aug. 14, 2017, from the United Statements Patent and Trademark Office, in counterpart U.S. Appl. No. 14/910,365.
Office Action issued to U.S. Appl. No. 14/912,234 dated May 17, 2017.
Notice of Allowance issued to U.S. Appl. No. 14/912,234 dated Oct. 31, 2017.
Kensuke Akamatsu et al., "Fabrication of Silver Patterns on Polyimide Films Based on Solid-Phase Electrochemical Constructive Lithography Using Ion-Exchangeable Precursor Layers", Langmuir 2011, vol. 27, No. 19, pp. 11761-11766 (6 pages total).
Office Action issued to U.S. Appl. No. 14/371,036 dated Sep. 30, 2016.
Office Action issued to U.S. Appl. No. 14/371,036 dated Jan. 17, 2017.
Notice of Allowance issued to U.S. Appl. No. 14/371,036 dated Sep. 20, 2017.
Notice of Allowance issued to U.S. Appl. No. 14/371,036 dated Jan. 9, 2018.
Corrected Notice of Allowability issued to U.S. Appl. No. 14/371,036 dated Jun. 4, 2018.
Corrected Notice of Allowability issued to U.S. Appl. No. 14/371,036 dated Jul. 18, 2018.
Schmidt J.A. et al., "Copper Electrodeposition on Glassy Carbon From a Solid Electrolyte", Electrochimica Acta, Elsevier Science Publishers, 1993, pp. 577-580, vol. 38, No. 4 (4 pages total).
Office Action issued to U.S. Appl. No. 15/064,226 dated Jun. 26, 2017.
Final Office Action issued to U.S. Appl. No. 15/064,226 dated Nov. 8, 2017.
Final Office Action issued to U.S. Appl. No. 15/064,226 dated May 10, 2018.
Notice of Allowance issued to U.S. Appl. No. 15/064,226 dated Aug. 30, 2018.

(56) References Cited

OTHER PUBLICATIONS

Corrected Notice of Allowability issued to U.S. Appl. No. 15/064,226 dated Sep. 12, 2018.

* cited by examiner

FILM DEPOSITION DEVICE OF METAL FILM AND METAL FILM DEPOSITION METHOD

BACKGROUND OF THE INVENTION

1. Field of the Invention

The invention relates to a film deposition device and a film deposition method of a metal film, in particular, a film deposition device and a film deposition method of a metal film, which can deposit a thin metal film uniformly on a surface of a base material.

2. Description of Related Art

Heretofore, when an electronic circuit base material or the like is manufactured, in order to form a metal circuit pattern, a metal film is deposited on a surface of a base material. For example, as a film deposition method of such a metal film, a film deposition technique in which a metal film is deposited on a surface of a semiconductor base material such as Si by plating such as electroless plating or the like (see Japanese Patent Application Publication No. 2010-037622 (JP 2010-037622 A), for example) and a film deposition technique in which a metal film is deposited by a PVD method such as sputtering have been proposed.

However, in the case where plating such as the electroless plating was applied, water cleansing was necessary after the plating, and an waste liquid after water cleansing was necessary to be treated. Further, when a film was deposited on a surface of a base material by a PVD method such as sputtering, since an internal stress was formed in a deposited metal film, a film thickness was limited from being thickened, in particular, in the case of sputtering, in some cases, the film deposition was possible only under high vacuum.

In view of points like this, for example, a film deposition method of a metal film, which uses a positive electrode, a negative electrode, a solid electrolyte membrane disposed between the positive electrode and negative electrode, and a power supply part that applies a voltage between the positive electrode and negative electrode is proposed (see JP 2012-219362 A, for example).

Here, the solid electrolyte membrane is formed in such a manner that a solution containing a precursor of a solid electrolyte is spin coated on a surface of a base material in advance and cured, and metal ions to be coated on the solid electrolyte membrane are impregnated. Then, the solid electrolyte membrane is faced to the positive electrode and the base material is disposed so as to be electrically connected with the negative electrode. By applying a voltage between the positive electrode and negative electrode, the metal ions impregnated inside the solid electrolyte are precipitated on a negative electrode side. Thus, a metal film made of the metal described above can be deposited.

However, when the technique disclosed in Japanese Patent Application Publication No. 2012-219362 (JP 2012-219362 A) was used, in some cases, an oxide was formed in the metal film and a deposited metal film and the solid electrolyte membrane were closely stuck. In particular, when a metal film was deposited by setting a flowing current at a high current density in order to deposit the metal film at high-speed, such a phenomenon became remarkable.

SUMMARY OF THE INVENTION

The present invention provides a film deposition device and a film deposition method of a metal film, which can reduce formation of an oxide in a deposited metal film and can suppress the metal film from closely sticking to a solid electrolyte membrane during film deposition.

After vigorous investigation, the present inventors considered the reason why the oxide is formed as follows. Specifically, in the proximity of an interface between the solid electrolyte membrane and the metal film, a velocity by which metal ions are supplied from the solid electrolyte membrane becomes slower with respect to a velocity by which the metal ions decrease due to metal precipitation, as a result thereof, a concentration of the metal ions decreases in the proximity of the interface. Thus, activity of the metal ions becomes lower and reduction of hydrogen ions (generation of hydrogen) prevails over reduction of metal ions (precipitation of metal). The metal hydroxide is dewatered thereafter and finally metal oxide is formed.

On the other hand, the reason why the deposited metal film and the solid electrolyte membrane closely stick was similarly considered as follows. In the proximity of an interface between the solid electrolyte membrane and the metal film, since a concentration of the metal ions decreases, a metal precipitation process becomes a rate-determining process due to material transfer from a rate-determining process due to charge transfer, and dendrite-like metal is precipitated. As a result thereof, irregularity increases on a surface of the metal film, thus the solid electrolyte membrane is likely to closely stick to the metal film due to an anchoring effect.

Then, the present inventors considered that in order to suppress the concentration of metal ions from decreasing in the proximity of an interface between the solid electrolyte membrane and the metal film like this, a water content of the solid electrolyte membrane is important. That is, it is considered that by making a water content contained in the solid electrolyte membrane rich, metal ions are diffused in a water cluster formed in the solid electrolyte membrane, and the metal ions can be conducted thereby.

A first aspect of the present invention relates to a film deposition device of a metal film, which includes a positive electrode, a solid electrolyte membrane, and a power supply part that applies a voltage between the positive electrode and a base material to be a negative electrode. The solid electrolyte allows a water content to be 15% by mass or more and is capable of containing metal ions. The power supply part applies a voltage between the positive electrode and the base material in a state where the solid electrolyte membrane is disposed on a surface of the positive electrode such that metal is precipitated on a surface of the base material from the metal ions contained inside the solid electrolyte membrane.

According to the film deposition device of the present invention, during film deposition, in a state where the solid electrolyte membrane is disposed on the positive electrode, the solid electrolyte membrane is brought into contact with the base material. When, in this state, a voltage is applied by the power supply part between the positive electrode and the base material to be a negative electrode, metal can be precipitated from the metal ions contained inside the solid electrolyte membrane on a surface of the base material. Thus, a metal film made of the metal of the metal ions can be deposited on a surface of the base material.

Here, by use of a solid electrolyte membrane of which water content is 15% by mass or more (a solid electrolyte membrane having a water containing capacity of 15% by mass or more as a water content) as the solid electrolyte membrane, the film deposition can be performed with the water content of the solid electrolyte membrane set to 15% by mass or more. Thus, when the water content of the solid electrolyte membrane is increased, an amount of water clusters can be increased.

As a result, since the metal ions are readily supplied from the solid electrolyte membrane to the proximity of an interface between the solid electrolyte membrane and the metal film, the concentration of the metal ions is suppressed from decreasing. Thus, since a local pH decrease accompanying the reduction of hydrogen ions is suppressed in the proximity of an interface between the solid electrolyte membrane and the metal film, generation of metal hydroxide is suppressed, and formation of metal oxide on a surface of the metal film becomes difficult thereby.

Further, in the precipitation process of the metal ions, since the charge transfer becomes faster than the material transfer, the dendrite-like metal is difficult to precipitate, the surface of the metal film becomes smooth, and the metal film becomes difficult to closely stick to the solid electrolyte membrane thereby.

Thus, even when a density of current that flows through the solid electrolyte membrane is high, since the transport velocity of the metal ions inside thereof is not lowered, the metal film can be more rapidly deposited. Here, in the case where the water content of the solid electrolyte membrane becomes less than 15% by mass, since the water content of the solid electrolyte membrane is low, the oxide is likely to be formed on a surface of the metal film, and the metal film tends to closely stick to the solid electrolyte membrane.

The positive electrode may be formed into a porous body through which a solution containing the metal ions is capable of transmitting such that the metal ions can be supplied to the solid electrolyte membrane. The positive electrode made of the porous body can transmit the solution containing the metal ions to the inside, and the transmitted solution (metal ions thereof) can be supplied to the solid electrolyte membrane. Thus, during film deposition, via the positive electrode that is a porous body, the solution containing the metal ions can be supplied as needed. The supplied solution transmits through the inside of the positive electrode and comes into contact with the solid electrolyte membrane adjacent to the positive electrode, the metal ions are impregnated in the solid electrolyte membrane and the water content of the solid electrolyte membrane can be held in the range described above.

As a result like this, the metal ions in the solid electrolyte membrane are precipitated during film deposition and can be stably supplied from the positive electrode side. Thus, without limiting an amount of metal that can be precipitated, a metal film having a desired film thickness can be continuously deposited on surfaces of a plurality of base materials.

The film deposition device may include a metal ion supply part that supplies a solution containing the metal ions to the positive electrode. When thus constituted, while supplying the solution containing metal ions from the metal ion supply part, metal films can continuously be deposited.

The film deposition device described above may include a pressing part that pressurizes the solid electrolyte membrane against the base material by moving the positive electrode toward the base material. Since the solid electrolyte membrane can be pressurized against the base material via the positive electrode by the pressing part, by making the electrolyte membrane uniformly follow a surface of the base material in a film deposition region, a metal film can be coated on a surface thereof. Thus, a homogeneous metal film having a uniform film thickness can be deposited on a surface of the base material.

A second aspect of the present invention relates to a metal film deposition method, which includes sandwiching the solid electrolyte membrane with the positive electrode and the base material to be a negative electrode such that the solid electrolyte membrane comes into contact with the positive electrode and the negative electrode; containing metal ions inside the solid electrolyte membrane; and depositing a metal film made of the metal on a surface of the base material by applying a voltage between the positive electrode and the negative electrode to precipitate the metal from metal ions contained inside the solid electrolyte membrane on a surface of the base material. By using a solid electrolyte membrane that is capable of containing a water content of 15% by mass or more as the solid electrolyte membrane, the film deposition is performed by setting the water content of the solid electrolyte membrane to 15% by mass or more.

According to the metal film deposition method, the solid electrolyte membrane is disposed on a surface of the positive electrode and the solid electrolyte membrane is brought into contact with the base material. In this state, a voltage is applied between the positive electrode and the base material to make the metal precipitate from metal ions contained inside the solid electrolyte membrane on a surface of the base material, and a metal film can be deposited on a surface of the base material thereby.

Here, since the film deposition is performed by setting the water content of the solid electrolyte membrane to 15% by mass or more, by increasing the water content of the solid electrolyte membrane, an amount of water clusters can be increased. As a result, since the metal ions from the solid electrolyte membrane become liable to be supplied to the proximity of an interface of the solid electrolyte membrane and the metal film, the concentration of the metal ions can be suppressed from decreasing. Thus, in the proximity of an interface of the solid electrolyte membrane and the metal film, since a local pH decrease accompanying the reduction of hydrogen ions can be suppressed, generation of metal hydroxide is suppressed, and oxide becomes difficult to be formed on a surface of the metal film.

Further, in the process of precipitation of the metal ions, since the charge transfer becomes faster than the material transfer, the dendrite-like metal becomes difficult to precipitate, a surface of the metal film becomes smooth, and the metal film is difficult to closely stick to the solid electrolyte membrane thereby.

Thus, even when a density of current that flows the solid electrolyte membrane is high, since a transport velocity of the metal ions inside thereof does not decrease, the metal film can be deposited at a higher speed. Here, in the solid electrolyte membrane of which water content is less than 15% by mass, since the water content is low, the oxide is likely to be formed on a surface of the metal film, and the metal film tends to closely stick to the solid electrolyte membrane thereby.

As the positive electrode, a porous body through which a solution containing the metal ions can transmit such that the metal ions are supplied to the solid electrolyte membrane may be used. Here, by using the positive electrode made of the porous body, the solution containing the metal ions can be transmitted to the inside thereof, and the transmitted solution can be supplied to the solid electrolyte membrane. Thus, during film deposition, via the positive electrode that is a porous body, the solution containing the metal ions can be supplied as needed. The solution containing the supplied metal ions transmits the inside of the positive electrode, comes into contact with the solid electrolyte membrane adjacent to the positive electrode, the metal ions are impregnated in the solid electrolyte membrane, and the water content of the solid electrolyte membrane can be maintained in the range described above thereby.

As a result like this, the metal ions in the solid electrolyte membrane are precipitated during film deposition and, at the same time, can be stably supplied from the positive electrode side. Therefore, without limiting an amount of metal that can be precipitated, the metal film having a desired film thickness can be continuously deposited on surfaces of a plurality of base materials.

The metal film may be deposited while supplying the solution containing the metal ions to the positive electrode. When thus performed, while supplying the solution containing the metal ions to the positive electrode, the metal films can be continuously deposited.

The solid electrolyte membrane may be pressurized against a film deposition region of the base material by moving the positive electrode toward the base material. When thus performed, since the solid electrolyte membrane can be pressurized via the positive electrode, by making the solid electrolyte membrane uniformly follow a surface of the base material in a film deposition region, a metal film can be coated on the surface.

According to the present invention, oxide formation on a metal film to be deposited can be reduced and, at the same time, the metal film can be suppressed from closely sticking to the solid electrolyte membrane.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
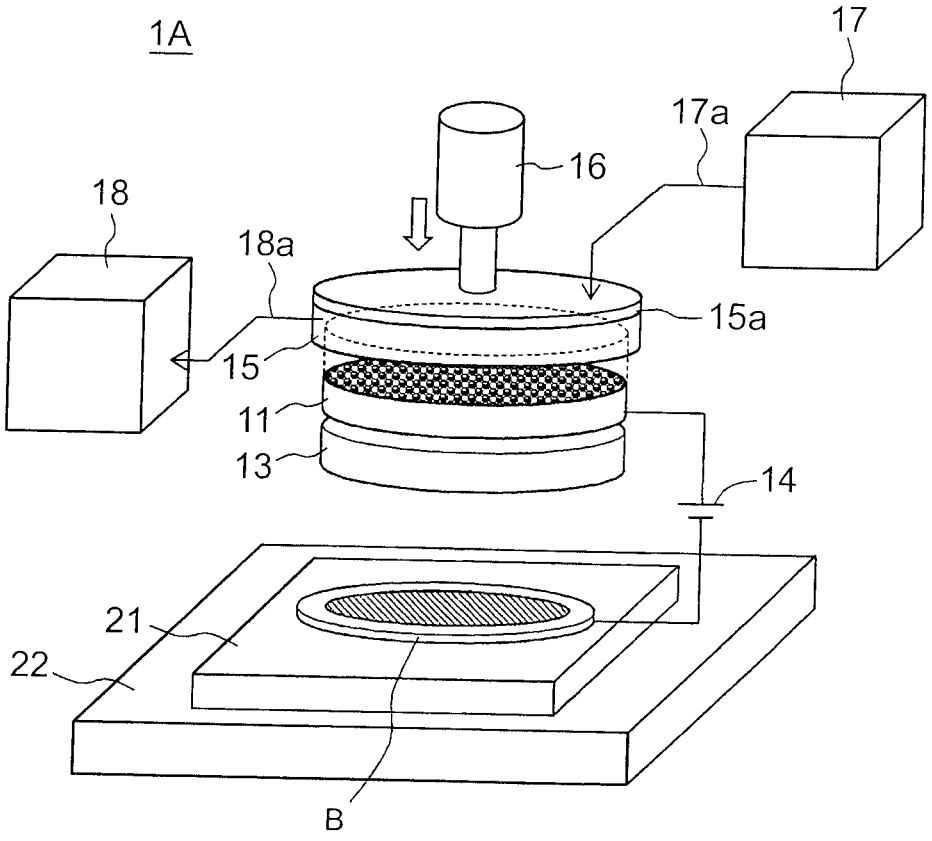
FIG. 1 is a schematic conceptual diagram of a film deposition device of a metal film according to the present embodiment of the present invention.

As shown in FIG. 1, a film deposition device 1A according to a first embodiment of the present invention makes metal precipitate from metal ions and deposits a metal film made of the deposited metal on a surface of a base material B. Here, as the base material B, a base material made of a metal material such as aluminum or a base material obtained by forming a metal underlayer on a surface to be treated of a resin or silicon base material is used.

The film deposition device 1A includes at least a positive electrode 11 made of metal, a solid electrolyte membrane 13 disposed on a surface of the positive electrode 11, and a power supply part 14 for applying a voltage between the positive electrode 11 and a base material B to be a negative electrode.

Further, on an upper surface of the positive electrode 11, a metal ion supply part 15 for supplying a solution containing metal ions (hereinafter, referred to as a metal ion solution) L to the positive electrode 11 is disposed. In a bottom part of the metal ion supply part 15, an opening is formed, and, in an internal space of the metal ion supply part 15, the positive electrode 11 is housed in a state engaged with an inner wall 15*b*.

A solution tank 17 in which the metal ion solution L is housed is connected via a supply tube 17*a* to one side of the metal ion supply part 15, and, to the other side thereof, a waste liquid tank 18 that recovers a waste liquid after use is connected via a waste liquid tube 18*a*.

When constituted like this, the metal ion solution L housed in the solution tank 17 can be supplied via the supply tube 17*a* to the inside of the metal ion supply part 15 and the waste liquid after use can be sent via the waste liquid tube 18*a* to the waste liquid tank 18.

Further, since the positive electrode 11 is housed in a state engaged with the inner wall 15*b* in an internal space of the metal ion supply part 15, the metal ion solution L supplied from above of the internal space can be supplied to the positive electrode 11. Here, the positive electrode 11 is made of a porous body that transmits the metal ion solution L and supplies metal ions to the solid electrolyte membrane. As such a porous body, as long as it has (1) corrosion resistance against the metal ion solution L, (2) the electric conductivity capable of operating as a positive electrode, (3) permeability of the metal ion solution L, and (4) capability of being pressed with a pressing part 16 described below, there is no particular restriction. For example, a foamed metal body made of a foam having continuous open cells, which has an ionization tendency lower than that of the film deposited metal (or higher in an electrode potential), such as foamed titanium can be used.

Further, regarding the condition of (3) described above, in the case where a foamed metal body is used, for example, it is preferable that the foamed metal body has the porosity of about 50 to 95% by volume, a pore diameter of about 50 to 600 μm, and a thickness of about 0.1 to 50 mm.

Further, a pressing part 16 is connected to a cap part 15*a* of the metal ion supply part 15. The pressing part 16 pressurizes the solid electrolyte membrane 13 against a film deposition region E of the base material B by moving the positive electrode 11 toward the base material B. For example, as the pressing part 16, a hydraulic or air cylinder and so on can be used.

Further, the film deposition device 1A includes a pedestal 21 that fixes the base material B and adjusts alignment of the base material B to be a negative electrode with respect to the positive electrode 11 and a temperature controller 22 that adjusts temperature of the base material B via the pedestal 21.

As the metal ion solution L, an aqueous solution that contains ions of, for example, copper, nickel, silver or the like can be used. For example, in the case of copper ion, a solution containing copper sulfate, copper pyrophosphate or the like can be used. As the solid electrolyte membrane 13, a membrane, a film or the like made of a solid electrolyte can be used.

The solid electrolyte membrane 13 is a membrane made of a solid electrolyte having the water content of 15% by mass or more, which, when brought into contact with the metal ion solution L described above, can impregnate the metal ions in the inside thereof, and in which the metal ions move on a surface of the base material B when a voltage is applied, and a metal derived from the metal ions is reduced and can be precipitated.

As a material of the solid electrolyte membrane, a fluororesin such as Nafion (registered trade mark) manufactured by DuPont, a hydrocarbon resin, or a resin having an, ion exchange function such as SELEMION (CMV, CMD, CMF series) manufactured by ASAHI GLASS Co., Ltd. can be used. By properly selecting a kind and a ratio of a functional group of a produced resin, a solid electrolyte (resin) of which a water content can be set to 15% by mass or more can be obtained. In general, as the number of the ion exchange groups increases, the water content of the solid electrolyte membrane can be increased, and these can be manufactured according to a generally well-known method. For example, by varying a hot-press time of these resins, the water content can be adjusted. In particular, as the resin that satisfies such a range of the water content, a resin such as a perfluorosulfonic acid resin can be used. Further, the upper limit of the water content of the solid electrolyte membrane is preferably 80% by mass or less, and, in this range, both of the metal ions and the water content can be preferably impregnated while maintaining the film strength.

Figure 2A:
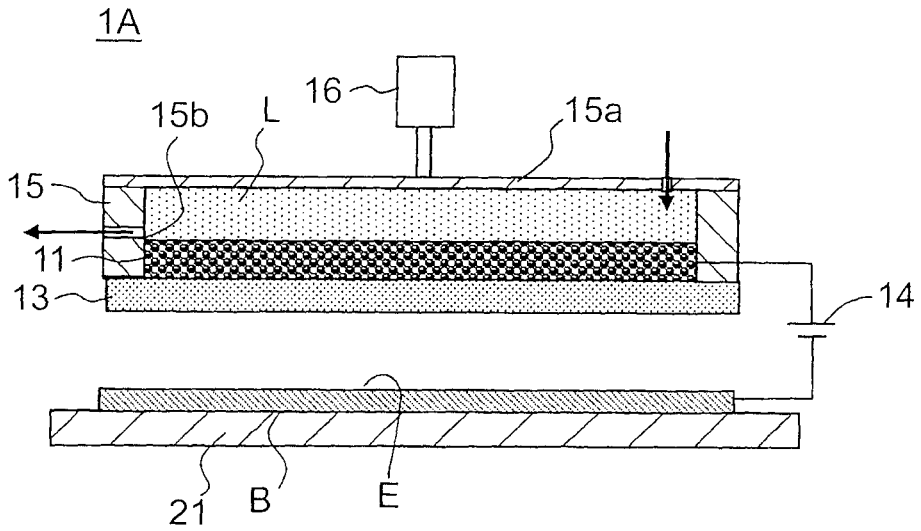
FIG. 2A is a schematic cross-sectional diagram for describing a film deposition method according to the film deposition device of a metal film shown in in FIG. 1 and a state of the film deposition device before film deposition.
Figure 2B:
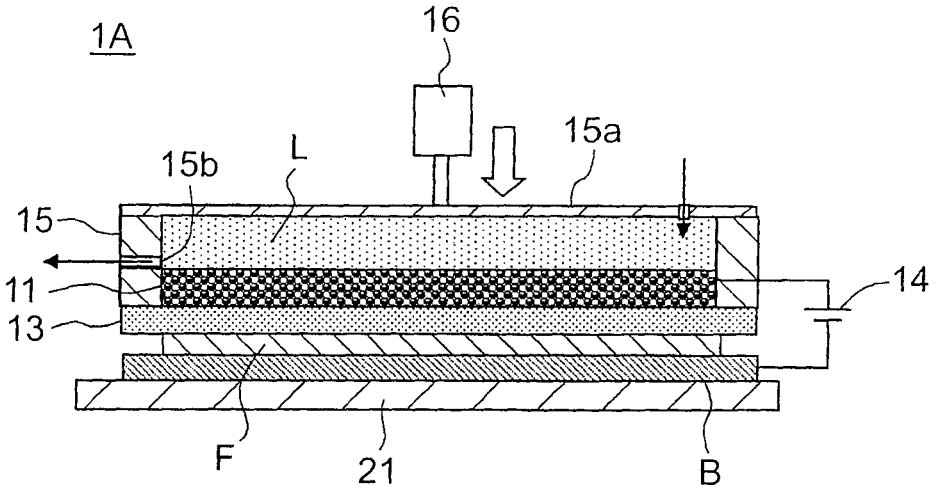
FIG. 2B is a schematic cross-sectional diagram for describing a film deposition method according to the film deposition device of a metal film shown in in FIG. 1 and a state of the film deposition device during film deposition.

Hereinafter, a film deposition method according to the present embodiment will be described. Firstly, on the pedestal 21, the base material B is disposed, alignment of the base material B is adjusted with respect to the positive electrode 11, and a temperature of the base material B is adjusted by a temperature controller 22. Next, as shown in FIG. 2B, the solid electrolyte membrane 13 is disposed on a surface of the positive electrode 11 that is made of a porous body, the solid electrolyte membrane 13 is brought into contact with the base material B, and the base material B is made conductive with the negative electrode of the power supply part 14.

Then, by means of the pressing part 16, the positive electrode 11 is moved toward the base material B, and the solid electrolyte membrane 13 is pressurized against the film deposition region E of the base material B thereby. Thus, since the solid electrolyte membrane 13 can be pressurized via the positive electrode 11, the solid electrolyte membrane 13 is made to uniformly follow a surface of the base material B of the film deposition region. That is, by electrical energization with the power supply part 14 described below while contacting (pressurizing) the solid electrolyte membrane 13 with the base material by use of the positive electrode 11 as a backup material, a metal film F having a more uniform film thickness can be deposited.

Next, by use of the power supply part 14, a voltage is applied between the positive electrode 11 and the base material B to be a negative electrode to precipitate metal from the metal ions contained inside the solid electrolyte membrane 13 on a surface of the base material B. At this time, the metal film F is deposited while supplying the metal ion solution L to the positive electrode 11.

As a result like this, by use of the positive electrode 11 made of a porous body, the metal ion solution L can be transmitted to the inside thereof, and the transmitted solution L can be supplied to the solid electrolyte membrane 13 together with the metal ions. Thus, during film deposition, the metal ion solution L can be supplied as needed to the solid electrolyte membrane 13 via the positive electrode 11 that is a porous body. The supplied metal ion solution L transmits the inside of the positive electrode 11 and comes into contact with the solid electrolyte membrane 13 adjacent to the positive electrode 11, and, the metal ions are impregnated in the solid electrolyte membrane 13 and the water content of the solid electrolyte membrane 13 can be maintained at 15% by mass or more.

Then, when a voltage is applied between the positive electrode 11 and the base material B to be a negative electrode, the metal ions inside the solid electrolyte membrane 13, which are supplied from the positive electrode side move from the positive electrode 11 side to the base material B side, and metal from the metal ions contained in the inside of the solid electrolyte membrane 13 is precipitated on a base material side. Thus, a metal film F can be deposited on a surface of the base material B.

According to the present embodiment, as the solid electrolyte membrane 13, a solid electrolyte membrane having the water content of 15% by mass or more (a solid electrolyte membrane having water containing capacity of 15% by mass or more as the water content) is used, and a film deposition is performed by setting the water content of the solid electrolyte membrane 13 to 15% by mass or more.

Here, the conduction of the metal ions in the solid electrolyte membrane is considered to be performed not by ion hopping like proton but by ion diffusion in a water cluster. By increasing the water content of the solid electrolyte membrane 13 (by setting to the water content described above), an amount of water cluster can be increased. Thus, a region in which a transition metal ion having a high valence can move is increased, and a transportation amount of ions per unit area can be increased.

As result like this, since the metal ions are made to be readily supplied from the solid electrolyte membrane 13 to the proximity of an interface between the solid electrolyte membrane 13 and the metal film F, a concentration of the metal ions can be suppressed from becoming lower. Thus, since in the proximity of an interface between the solid electrolyte membrane 13 and the metal film F, a local pH decrease accompanying the reduction of hydrogen ions can be suppressed from occurring, generation of metal hydroxide derived from the metal ions is suppressed and formation of oxide on a surface of the metal film F becomes difficult.

Further, in the process of precipitation of metal ions, since the charge transfer becomes faster than the material transfer, the dendrite-like metal is difficult to be precipitated, a surface of the metal film F becomes smooth, and the metal film F is difficult to closely stick to the solid electrolyte membrane 13.

Thus, even when a density of current that flows the solid electrolyte membrane 13 is high, since a transport velocity of the metal ions inside thereof does not decrease, the metal film F can be deposited at a higher speed.

Here, in the case where the water content of the solid electrolyte membrane 13 becomes less than 15% by mass, since the water content of the solid electrolyte membrane 13 is low, oxide is likely to be formed on a surface of the metal film F, and the metal film F tends to closely stick to the solid electrolyte membrane 13 thereby.

Further, since the metal ion solution L can be supplied as needed via the positive electrode 11 that is a porous body, without limiting an amount of metal that can be precipitated, a metal film F having a desired film thickness can be continuously deposited on surfaces of a plurality of base materials B.

The present invention will be described with reference to the following examples.

Example 1

By use of a device shown in FIG. 1 described above, a metal film was deposited. As a base material on a surface of which a film is deposited, a pure aluminum base material (50 mm×50 mm×thickness 1 mm) was prepared, on a surface of which a nickel plating film was formed, further a gold plating film was formed on a surface of the nickel plating film. Next, a positive electrode obtained by coating platinum plating at a thickness of 3 μm on a surface that faces a film deposition region of a surface of a porous body (manufactured by Mitsubishi Material Corporation) that is made of a 10 mm×10 mm×1 mm foamed titanium and has the porosity of 65% by volume was used.

A mass of a solid electrolyte membrane in a dry state (dry mass) was measured, after immersing this in pure water, moisture attached on a surface thereof was wiped, in this state, a mass of the solid electrolyte membrane (mass in wet base) was measured, and the water content (% by mass) was calculated according to the following formula.

(Mass in wet base−Dry mass)/Mass in wet base

As a metal ion solution, a solution of 1 mol/L copper sulfate was prepared, while pressurizing under 0.5 MPa from above the positive electrode, at normal temperature for a treatment time of 30 minutes, a copper film was deposited on a surface of a base material. At this time, the limiting current density during film deposition (the maximum current density that does not generate film abnormality) was measured. The results are shown in the following Table 1 and FIG. 3.

Examples 2 to 5

In the same manner as Example 1, a copper film was manufactured on a surface of the base material. Specifically, the solid electrolyte membrane of Example 2 had the water content of 30% by mass, the solid electrolyte membrane of Example 3 had the water content of 28% by mass, the solid electrolyte membrane of Example 4 had the water content of 28% by mass, and the solid electrolyte membrane of Example 5 had the water content of 23% by mass.

With film deposition devices of these Examples 2 to 5, in the same manner as Example 1, the limiting current density during film deposition (the maximum current density that does not generate film abnormality) was measured. The results are shown in the following Table 1 and FIG. 3.

Comparative Example 1 and 2

In the same manner as Example 1, a copper film was formed on a surface of a base material. Except Example 2, the water content was different from that of Example 1 (capacity that can contain water is different). Specifically, a solid electrolyte membrane of Comparative Example 1 had the water content of 11% by mass and a solid electrolyte membrane of Comparative Example 2 had the water content of 9% by mass.

With film deposition devices of Comparative Example 1 and 2, in the same manner as Example 1, the limiting current density during film deposition (the maximum current density that does not generate film abnormality) was measured. The results are shown in the following Table 1 and FIG. 3.

TABLE 1

| | Water content of solid electrolyte membrane (% by mass) | Limiting current density ($mA/cm^2$) |
|---|---|---|
| Example 1 | 30 | 45 |
| Example 2 | 30 | 30 |
| Example 3 | 28 | 25 |

TABLE 1-continued

| | Water content of solid electrolyte membrane (% by mass) | Limiting current density ($mA/cm^2$) |
|---|---|---|
| Example 4 | 28 | 25 |
| Example 5 | 23 | 10 |
| Comparative Example 1 | 11 | <5 |
| Comparative Example 2 | 9 | <5 |

Figure 3:
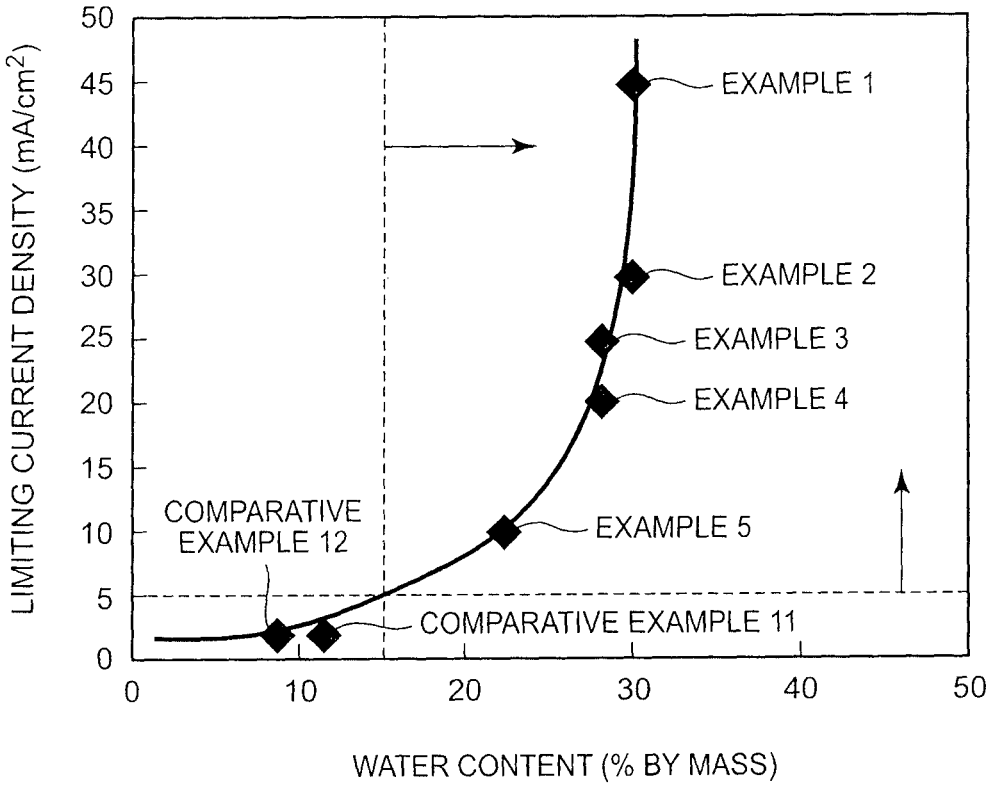
FIG. 3 is a diagram showing a relationship between water contents of solid electrolyte membranes of the film deposition devices according to Examples 1 to 5 and Comparative Examples 1 and 2 and limiting current densities.

(Results) As shown in FIG. 3, when films were deposited with the film deposition devices of Examples 1 to 5, the limiting current densities were 10 $mA/cm^2$ or more. However, when films were deposited with film deposition devices of Comparative Examples 1 and 2, the limiting current densities were less than 5 $mA/cm^2$. From this result, it is considered that when the water content of the solid electrolyte membrane is 15% by mass or more like Examples 1 to 5, the limiting current density exceeds 5 $mA/cm^2$, and film deposition can be performed at a higher speed.

In the above, Embodiments of the present invention were described in more detail. However, the present invention is not limited to the embodiments described above, and various design modifications can be applied.

The invention claimed is:

1. A film deposition device for deposition of a metal film, the film deposition device comprising a metal ion supplier configured to supply a solution containing metal ions, the metal ion supplier including an opening having an internal space and an inner wall;

a metal positive electrode disposed in the internal space of the opening of the metal ion supplier and being engaged with the inner wall of the opening of the metal ion supplier;

a solid electrolyte membrane disposed on a surface of the positive electrode, the solid electrolyte membrane having a water content of between 15% and 80%, inclusive, by mass, and the solid electrolyte membrane being capable of containing metal ions;

a power supply part configured to apply a voltage between the metal positive electrode and a base material configured to be a negative electrode in a state where the solid electrolyte membrane is disposed on the surface of the metal positive electrode between the metal positive electrode and the base material such that metal is precipitated on a surface of the base material from the metal ions contained inside the solid electrolyte membrane;

a pressing part configured to pressurize the solid electrolyte membrane against the base material by moving the metal positive electrode toward the base material, the pressing part being connected to a cap part of the metal ion supplier;

a solution tank configured to house the solution containing the metal ions, the solution tank being connected via a supply tube to one side of the metal ion supplier;

a waste liquid tank configured to recover waste liquid, the waste liquid tank being connected via a waste liquid tube to another side of the metal ion supplier;

a pedestal configured to fix the base material and adjust alignment of the base material; and a temperature controller configured to adjust the temperature of the base material via the pedestal;

wherein the metal positive electrode is a foamed metal body made of foam having continuous open cells, wherein the solution containing the metal ions is capable of transmitting through the metal positive electrode such that the metal ions are supplied to the solid electrolyte membrane.

2. The film deposition device for deposition of a metal film according to claim 1, wherein the metal positive electrode has a porosity of between 50 to 95% by volume, a pore diameter of 50 to 600 μm, and a thickness of between 0.1 and 50 mm.

3. A film deposition device for deposition of a metal film, the film deposition device comprising a metal ion supplier configured to supply a solution containing metal ions, the metal ion supplier including an opening having an internal space and an inner wall;

a metal positive electrode disposed in the internal space of the opening of the metal ion supplier and being engaged with the inner wall of the opening of the metal ion supplier; and a solid electrolyte membrane disposed on a surface of the positive electrode, the solid electrolyte membrane having a water content of between 15% and 80%, inclusive, by mass, and the solid electrolyte membrane being capable of containing metal ions;

wherein the metal positive electrode is a foamed metal body made of foam having continuous open cells.

4. The film deposition device for deposition of a metal film according to claim 3, the film deposition device further comprising:

a power supply part configured to apply a voltage between the metal positive electrode and a base material configured to be a negative electrode in a state where the solid electrolyte membrane is disposed on the surface of the metal positive electrode between the metal positive electrode and the base material such that metal is precipitated on a surface of the base material from the metal ions contained inside the solid electrolyte membrane; and, a pressing part configured to pressurize the solid electrolyte membrane against the base material by moving the metal positive electrode toward the base material, the pressing part being connected to a cap part of the metal ion supplier.

* * * * *